US007021947B1

(12) United States Patent
Purdy

(10) Patent No.: US 7,021,947 B1
(45) Date of Patent: Apr. 4, 2006

(54) METHOD AND ASSEMBLY FOR CONNECTING A COAXIAL CABLE TO A CONNECTING PORT

(75) Inventor: Eric Purdy, Constantia, NY (US)

(73) Assignee: John Mezzalingua Associates, East Syracuse, NY (US)

( * ) Notice: Subject to any disclaimer, the term of this patent is extended or adjusted under 35 U.S.C. 154(b) by 0 days.

(21) Appl. No.: 10/951,108

(22) Filed: Sep. 27, 2004

(51) Int. Cl.
*H01R 13/44* (2006.01)

(52) U.S. Cl. ..... 439/133; 439/304; 439/306

(58) Field of Classification Search ..... 439/133, 439/304, 306
See application file for complete search history.

(56) References Cited

U.S. PATENT DOCUMENTS

| | | | | |
|---|---|---|---|---|
| 3,519,979 | A | 7/1970 | Bodenstein | |
| 3,845,454 | A | 10/1974 | Hayward et al. | |
| 3,861,770 | A | 1/1975 | Horak | |
| 3,953,097 | A | 4/1976 | Graham | |
| 4,053,195 | A | 10/1977 | Laverick et al. | |
| 4,163,594 | A * | 8/1979 | Aujla | 439/304 |
| 4,168,921 | A * | 9/1979 | Blanchard | 439/133 |
| 4,393,583 | A | 7/1983 | Zwald | |
| 4,469,386 | A | 9/1984 | Ackerman | |
| 4,645,281 | A * | 2/1987 | Burger | 439/133 |
| 4,750,898 | A * | 6/1988 | Soulard | 439/133 |
| 4,759,122 | A | 7/1988 | Weintraub | |
| 4,806,116 | A * | 2/1989 | Ackerman | 439/304 |
| 4,824,386 | A * | 4/1989 | Souders | 439/133 |
| 5,011,422 | A | 4/1991 | Yeh | |
| 5,273,444 | A | 12/1993 | Down et al. | |
| 5,440,282 | A | 8/1995 | Devendorf et al. | |
| 5,564,938 | A | 10/1996 | Shenkal et al. | |
| H1689 | H | 11/1997 | Foucher | |
| 5,723,818 | A | 3/1998 | Yeh | |
| 5,749,272 | A | 5/1998 | Phan | |
| 6,153,830 | A | 11/2000 | Montena | |
| 6,848,920 | B1 * | 2/2005 | Fox | 439/133 |

* cited by examiner

*Primary Examiner*—Tho D. Ta
(74) *Attorney, Agent, or Firm*—Wood, Phillips, Katz, Clark & Mortimer

(57) ABSTRACT

An assembly for connecting a coaxial cable to a connecting port. The connecting assembly has a tubular fitting with a central axis and axially spaced first and second ends. The tubular fitting is operatively engageable with a coaxial cable directed into axially overlapping relationship with the tubular fitting at the first end of the tubular fitting. The tubular fitting has a first connecting assembly including a first connecting part that is movable around the central axis selectively in (a) a first direction to a secured state and (b) oppositely to the first direction from the secured state into a released state. In the secured state, the first connecting part maintains a coaxial cable, operatively engaged with the tubular fitting, connected to the connecting port. A shield assembly blocks radial access to the first connecting assembly in a manner that allows the first connecting part to be accessed and moved from the secured state into the released state with the shield assembly in the operative state. The shield assembly cooperates with the tubular fitting to allow the shield assembly to be placed, and maintained, in the operative state by relative axial movement of the shield assembly and tubular fitting.

43 Claims, 9 Drawing Sheets

METHOD AND ASSEMBLY FOR CONNECTING A COAXIAL CABLE TO A CONNECTING PORT

BACKGROUND OF THE INVENTION

1. Field of the Invention

This invention relates to connectors for coaxial cable and, more particularly, to a method and assembly for connecting a coaxial cable to a connecting port whereby separation of the coaxial cable from the connecting port is controlled.

2. Background Art

In many environments, coaxial cable is releasably electrically and mechanically connected at a port. The particular applications vary significantly. As one example, coaxial cables are commonly releasably electrically and mechanically connected to provide cable television transmission in both residential and commercial environments. In another application, the coaxial cable is connected both electrically and mechanically to a security camera, or other types of equipment. In this latter arrangement, the cable is capable of communicating signals from the camera to one or more remote monitors that are part of a surveillance system.

While the use of releasable connectors facilitates the installation of systems utilizing coaxial cable, it also introduces a potential security problem. In the absence of some safeguards, the cable connections can be compromised and signals rerouted or interrupted. For example, an individual might disconnect the cable transmitting a cable television signal and reroute the cable to avoid paying for a particular service. The potential for breach is also a problem in an environment wherein the coaxial cable is releasably, electrically and mechanically, connected to a surveillance camera.

In an exemplary camera connection, a "BNC" connector is utilized. A female connecting part is slotted to make a bayonet-type connection with projections on a port associated with the camera. The female connecting part has a generally circular outer surface that is knurled to facilitate gripping between a person's fingers. An individual attempting to breach the security system may grasp the knurled portion and manipulate the female connecting part to reverse the assembly steps.

The industry has recognized that connections, be they bayonet-type connections, threaded connections, etc., between male and female connecting parts, are vulnerable to tampering. A number of safeguards have been devised to deter unauthorized disconnection of a coaxial cable. Designers of these safeguards face a number of challenges.

First, the structure must be effective in providing a safeguard against tampering. Secondly, the structure should be relatively uncomplicated, so as not to add significantly to the cost of manufacturing connectors. Third, the design should be such as to facilitate use of connectors in a conventional manner without significant inconvenience to installers.

It is common in the cable industry, and in other areas, for installers to be pressured to conclude installations in an efficient manner. Compensation may be correlated to productivity. This may lead installers to seek all reasonable shortcuts to complete installations. If the structure that safeguards a connection is something that is time consuming to install, and it is possible to effect connections without this structure, it is reasonable to assume that installers often will forgo installation of the safeguarding structure and proceed with a conventional installation that might be easily defeated by an unscrupulous individual.

The industry continues to seek out safeguards that are inexpensive, effective, and will be reliably and consistently used by installers, in the many different industries that utilize cable connectors.

SUMMARY OF THE INVENTION

In one form, the invention is directed to an assembly for connecting a coaxial cable to a connecting port. The connecting assembly has a tubular fitting with a central axis and axially spaced first and second ends. The tubular fitting is operatively engageable with a coaxial cable directed into axially overlapping relationship with the tubular fitting at the first end of the tubular fitting. The tubular fitting has a first connecting assembly including a first connecting part that is movable around the central axis selectively in (a) a first direction to a secured state and (b) oppositely to the first direction from the secured state into a released state. In the secured state, the first connecting part maintains a coaxial cable, operatively engaged with the tubular fitting, connected to the connecting port. A shield assembly blocks radial access to the first connecting assembly in a manner that allows the first connecting part to be accessed and moved from the secured state into the released state with the shield assembly in the operative state. The shield assembly cooperates with the tubular fitting to allow the shield assembly to be placed, and maintained, in the operative state by relative axial movement of the shield assembly and tubular fitting.

The assembly may be provided in combination with a tool that can be directed into engaged relationship with the first connecting part by axial movement of the tool relative to the first connecting part, whereupon the tool can be manipulated to move the first connecting part between the secured state and the released state.

In one form, the first connecting part has a substantially circular, radially facing, outer surface. There are a cooperating radially extending rib and receptacle, one each on the tool and first connecting part. The rib is movable into the receptacle to key the tool and first connecting part so that the tool can be moved around the central axis to change the first connecting part from the secured state into the released state.

In one form, the outer surface is knurled to facilitate gripping engagement between the fingers of a user.

In one form, there is a first shoulder on the tubular fitting facing a first axial direction and a second shoulder on the shield assembly facing oppositely to the first axial direction. At least a part of at least one of the tubular fitting and shield assembly is deformable to allow the first and second shoulders to move past each other as the shield assembly is moved into the operative state, whereupon the first and second shoulders confront each other to block separation of the shield assembly and tubular fitting by relative axial movement away from each other.

In one form, one of the first and second shoulders is defined by a deflectable, cantilevered tab.

In one form, one of the first and second shoulders is defined by a wall having axially spaced ends connected to one of the shield assembly and tubular fitting. The one of the first and second shoulders resides between the axially spaced ends of the wall.

In one form, the shield assembly has a sleeve that is movable relative to the tubular fitting in an axial direction from the second end of the tubular fitting toward the first end of the tubular fitting, to be placed in the operative state.

In one form, the sleeve has axially spaced ends and an annular wall that has a substantially constant diameter between the axially spaced ends of the sleeve.

In one form, the annular wall has a stepped diameter between the axially spaced ends of the sleeve so as to conform to the shape of at least a part of the tubular fitting.

In one form, with the shield assembly in the operative state, at least a part of the shield assembly and first connecting assembly are movable relative to each other around the central axis.

In one form, with the shield assembly in the operative state, the shield assembly projects beyond the second axial end of the tubular fitting.

The assembly may be provided in combination with a coaxial cable operatively engaged with the tubular fitting.

The assembly may further be provided in combination with a connecting port to which the first connecting part is operatively connected.

In one form, the connecting port is part of a portable electronic object.

In another form of the invention, an assembly is provided for connecting a coaxial cable to a connecting port. The connecting assembly includes a tubular fitting having a central axis and axially spaced first and second ends. The tubular fitting is operatively engageable with a coaxial cable directed into axially overlapping relationship with the tubular fitting at the first end of the tubular fitting. The tubular fitting has a first connecting assembly including a first connecting part that is movable around the central axis selectively in (a) a first direction to a secured state and (b) oppositely to the first direction from the secured state into a released state. In the secured state the first connecting part maintains a coaxial cable, operatively engaged with the tubular fitting, connected to the connecting port. The first connecting part has a radially facing outer surface that is substantially circular around the central axis. A shield assembly blocks access to the outer surface in such a manner that allows the outer surface of the first connecting part to be gripped between a user's finger to facilitate turning of the first connecting part around the central axis with the shield assembly in an operative state.

In one form, the outer surface is knurled to facilitate gripping engagement between the fingers of a user.

The shield assembly may be integrally formed with the tubular fitting.

In one form, the shield assembly cooperates with the tubular fitting to allow the shield assembly to be placed, and maintained, in an operative state by relative axial movement of the shield assembly and tubular fitting.

The assembly may be provided in combination with a tool that can be directed into engaged relationship with the first connecting part by axial movement of the tool relative to the first connecting part, whereupon the tool can be manipulated to move the first connecting part between the secured state and the released state.

In one form, there are a cooperating radially extending rib and receptacle, one each on the tool and first connecting part. The rib is movable into the receptacle to key the tool and first connecting part so that the tool can be moved around the central axis to thereby change the first connecting part from the secured state into the released state.

In one form, there is a first shoulder on the tubular fitting facing a first axial direction and a second shoulder on the shield assembly facing oppositely to the first axial direction. At least a part of at least one of the tubular fitting and shield assembly is deformable to allow the first and second shoulders to move past each other as the shield assembly is moved into the operative state, whereupon the first and second shoulders confront each other to block separation of the shield assembly and tubular fitting by relative axial movement away from each other.

In one form, the shield assembly includes a sleeve that is movable relative to the tubular fitting in an axial direction from the second end of the tubular fitting toward the first end of the tubular fitting, to thereby be placed in the operative state.

In one form, with the shield assembly in the operative state, at least part of the shield assembly and first connecting assembly are movable relative to each other around the central axis.

The connecting assembly may be provided in combination with a coaxial cable operatively engaged with the tubular fitting.

In another form, the assembly is provided in combination with a connecting port to which the first connecting part is operatively connected.

The connecting port may be part of a portable electronic object.

The invention is further directed to an assembly for connecting a coaxial cable to a connecting port. The connecting assembly has a tubular fitting with a central axis and axially spaced first and second ends. The tubular fitting is operatively engageable with a coaxial cable directed into axially overlapping relationship with the tubular fitting at the first end of the tubular fitting. The tubular fitting has a first connecting assembly with a first connecting part that is movable around the central axis selectively in (a) a first direction to a secured state and (b) oppositely to the first direction from the secured state into a released state. In the secured state, the first connecting part maintains a coaxial cable, operatively engaged with the tubular fitting, connected to the connecting port. A shield assembly blocks radial access to the first connecting assembly in a manner that allows the first connecting part to be accessed and moved from the secured state into the released state. Structure is provided on the shield assembly and tubular fitting that cooperates to allow the shield assembly to be placed, and maintained, in an operative state by relative movement of the shield assembly and tubular fitting.

In one form, the shield assembly is placed, and maintained, in the operative state by relative axial movement between the shield assembly and tubular fitting.

In one form, the shield assembly is placed, and maintained, in the operative state by relative movement between the shield assembly and tubular fitting, one against and relative to the other.

The connecting assembly may be provided in combination with a tool that can be directed into engaged relationship with the first connecting part by axial movement of the tool relative to the first connecting part, whereupon the tool can be manipulated to move the first connecting part from the secured state into the released state.

In one form, the shield assembly has a sleeve that is movable relative to the tubular fitting in an axial direction from the second end of the tubular fitting toward the first end of the tubular fitting to be placed in the operative state.

In one form, with the shield assembly in the operative state, at least a part of the shield assembly and first connecting assembly are movable relative to each other around the central axis.

The connecting assembly may be provided in combination with a coaxial cable operatively engaged with the tubular fitting.

The connecting assembly may further be provided in combination with a connecting port to which the first connecting part is operatively connected.

In one form, the connecting port is part of a portable electronic object.

The invention is further directed to a method of assembling a coaxial cable to a connecting port. The method includes the steps of: providing a tubular fitting having a central axis and axially spaced first and second ends and including a first connecting assembly with a first connecting part that is movable around the central axis selectively in (a) a first direction to a secured state and (b) oppositely to the first direction from the secured state into a released state; providing a shield assembly; moving the shield assembly relative to the tubular fitting so as to thereby place, and maintain, the shield assembly in an operative state wherein the shield assembly blocks radial access to the first connecting assembly in a manner that allows the first connecting part to be accessed and moved from the secured state into the released state; operatively connecting the coaxial cable to the tubular fitting at one axial end of the tubular fitting; and operatively connecting the first connecting part to the connecting port to connect the coaxial cable to the connecting port.

In one form, the step of moving the shield assembly relative to the tubular fitting involves snap fitting the shield assembly into the operative state.

The step of operatively connecting the first connecting part may involve moving a projection on the connecting port axially within a first leg of a slot in the first connecting part a predetermined axial distance, and thereafter moving the first connecting part around the central axis in the first direction into the secured state, whereby the projection moves in a second leg of the slot that is traverse to, and contiguous with, the first leg of the slot.

The method may further include the steps of directing a tool axially relative to the first connecting part and against the first connecting part and, through manipulation of the tool, causing the first connecting part to be moved from the secured state into the released state.

The step of providing a tubular fitting may involve providing a tubular fitting with a first connecting part having a radially outwardly facing surface that is substantially circular around the central axis and knurled to facilitate gripping engagement between the fingers of a user.

In one form, the step of moving the shield assembly involves moving the shield assembly relative to the tubular fitting in an axial direction from the other axial end of the tubular fitting toward the one axial end of the tubular fitting.

In one form, the step of placing the shield assembly in the operative state involves placing the shield assembly in the operative state so that at least a part of the shield assembly and first connecting assembly are movable relative to each other around the central axis.

DETAILED DESCRIPTION OF THE DRAWINGS

Figure 1:
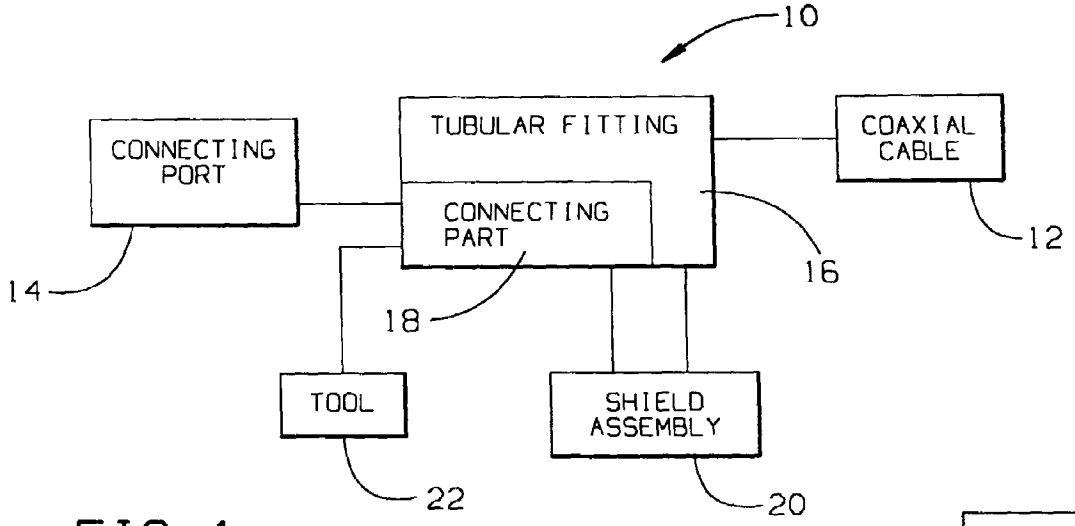
FIG. 1 is a schematic representation of an assembly for connecting a coaxial cable to a connecting port, according to the present invention, with the connecting assembly including a shield assembly that blocks access to a connecting part on the connecting assembly, thereby requiring the use of a tool to reposition the connecting part.

Referring initially to FIG. 1, an assembly is shown schematically at 10 for connecting a coaxial cable 12 to a connecting port 14. The assembly 10 consists of a tubular fitting 16 having a connecting part 18 that is joined to the connecting port 14 to mechanically and electrically connect the coaxial cable 12 at the connecting port 14. The assembly 10 shown is intended to represent a wide range of different structures as conventionally used to mechanically and/or electrically connect a coaxial cable to a connecting port. It is typical of these assemblies 10 that the connecting part 18 be engaged, either directly through a user's hand or a tool, to be repositioned between a secured state and a released state.

The assembly 10 includes a shield assembly 20 which is designed to obstruct normal access to the connecting part 18, whereby the connecting port 18 can be changed from the secured state into the released state. In FIG. 1, the shield assembly 20 is shown as a separate element that can be attached to the tubular fitting 16 through the connecting part 18, or as shown in dotted lines, to some other part of the tubular fitting 16.

Figure 2:
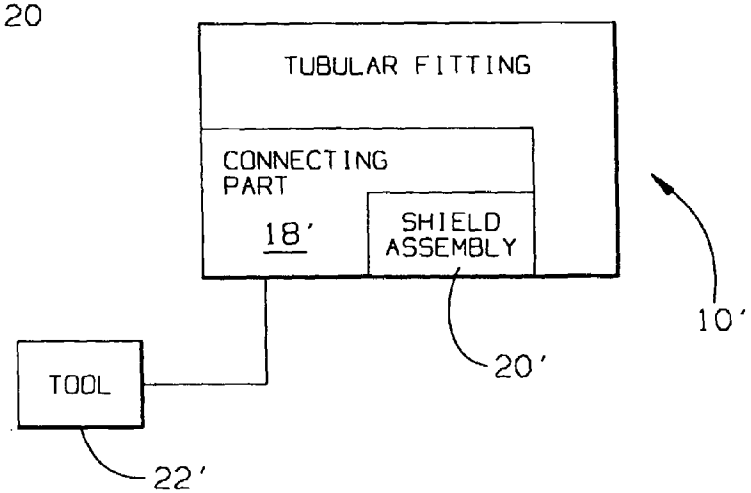
FIG. 2 is a schematic representation of a modified form of connecting assembly, according to the present invention.

A modified form of assembly for connecting a coaxial cable to a connecting port is shown generically in FIG. 2 at 10'. The assembly 10' has a connecting part 18' that is integrally formed with the shield assembly 20', as opposed to being joinable thereto, as on the assembly 10 in FIG. 1. Whereas the assembly 10 allows selective use of the shield assembly 20, the connecting part 18' and shield assembly 20' are inseparably joined so that assembly 10' is usable only with the connecting part 18' integrally joined with the shield assembly 20'.

With the shield assemblies 20,20' in an operative state, a tool 22,22' is required to access the connecting parts 18,18' to effect repositioning thereof from the secured state into the released state. Through this arrangement, separation of the assemblies 10,10' can be controlled by limiting access to the tools 22,22' required to reposition the connecting parts 18, 18' between secured and released states.

One form of the inventive structure, shown schematically in FIG. 1, is depicted in FIGS. 3–8. The assembly 10, consisting of the aforementioned tubular fitting 16 and shield assembly 20, is shown to electrically and mechanically connect the coaxial cable 12 at the connecting port 14, in this case shown in FIGS. 3 and 5 as an electronic device 24, that may be a camera, or other type of device or object. The connecting port 14 is typically configured on cameras, and the like, to accommodate a connecting assembly 26, which includes the connecting part 18, that is movable around a central axis 28 for the tubular fitting 16 at one axial end 30 of the tubular fitting 16. The axial end 32 of the tubular fitting 16, opposite the end 30, is designed to accept the coaxial cable 12, by directing an end thereof axially in the direction of the arrow 34 in FIG. 3 through an opening 36 into axially overlapping relationship with the tubular fitting 16.

The precise nature of the coaxial cable 12, and the structure on the tubular fitting 16 for operatively engaging the coaxial cable 12, are not critical to the present invention. One suitable structure for accomplishing this is shown, for example, in U.S. Pat. No. 6,153,830, which is incorporated herein by reference.

Figure 8:
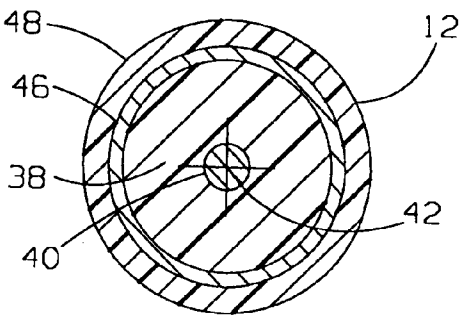
FIG. 8 is an enlarged, cross-sectional view of the coaxial cable taken along line 8—8 of FIG. 5.

In one conventional coaxial cable construction, as shown in FIG. 8, an insulating, cylindrical core 38 surrounds an inner conductor 40, having an axis 42 that is concentric with the central axis 44 (FIG. 5) of the coaxial cable 12. A metallic sheath 46, in the form of a braided wire or a foil, surrounds the insulating core 38 and is in turn surrounded by a dielectric, insulating jacket 48.

Figure 3:
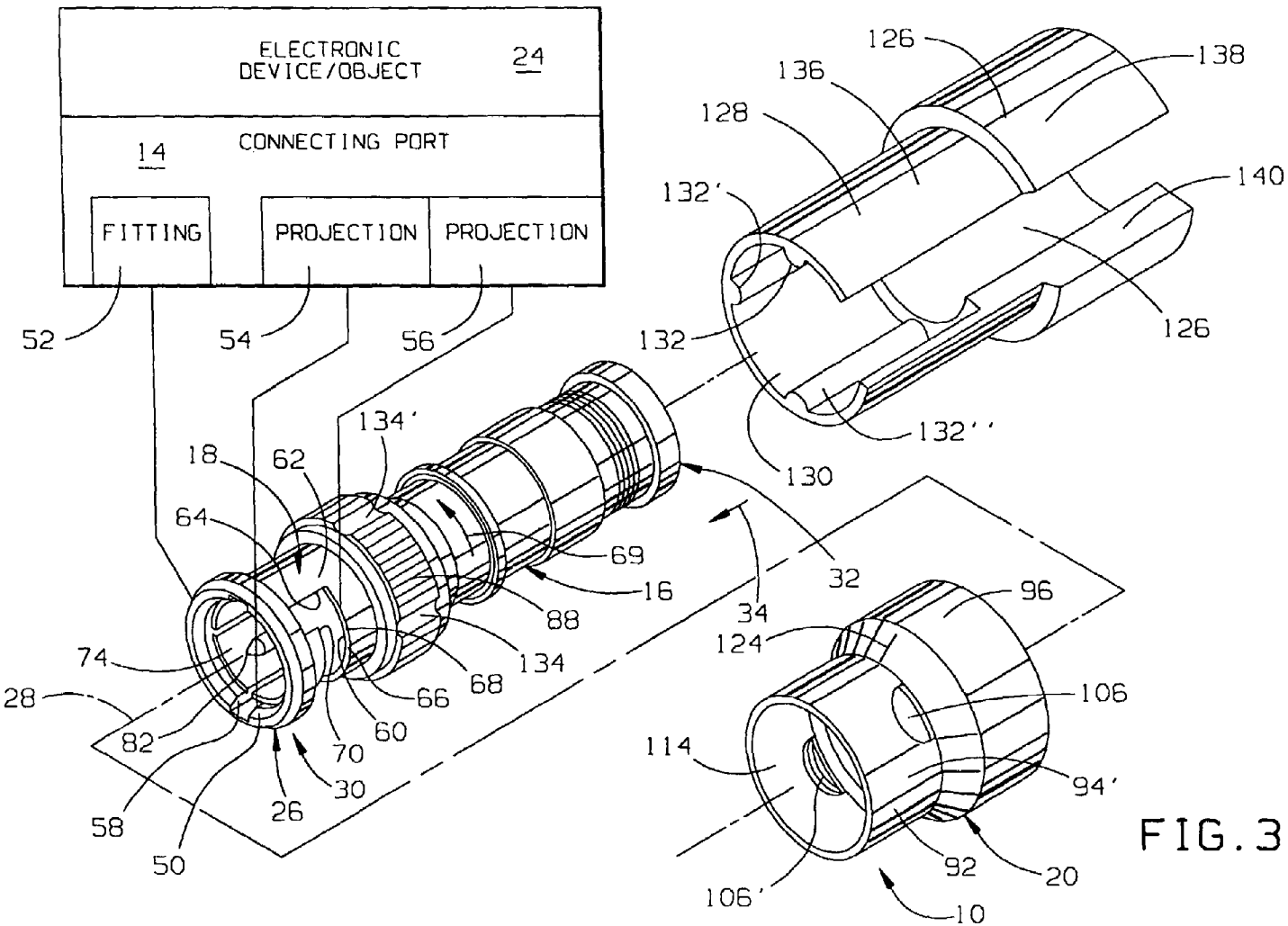
FIG. 3 is an exploded, partially schematic, perspective view of the tubular fitting of FIG. 1, operatively connected to the connecting port, and with one form of shield assembly and tool for operating the connecting part on the tubular fitting with the shield assembly in an operative state.

The connecting assembly 26 shown is what is referred to in the industry as a "BNC" connector. The connecting assembly 26 functions to both electrically and mechanically couple the coaxial cable 12 at the connecting port 14. Mechanical connection is effected through the connecting part 18, as seen in FIG. 3. The connecting part 18 has an annular end 50, which is telescopingly engaged with a fitting 52 on the connecting port 14.

The connecting port 14 has spaced projections 54,56 which move, one each, into diametrically oppositely located, L-shaped slots 58,60 through an annular wall 62 on the connecting part 18. The slots 58,60 have the same construction. Exemplary slot 60 has a first leg 64 that extends in an axial direction a predetermined distance and is contiguous with a transverse leg 66. The connecting part 18 is mechanically connected to the connecting port 14 by situating the annular end 50 at the fitting 52 and angularly aligning the projections 54,56, one each with the slots 58,60. By thereafter telescopingly mating the annular end 50 and fitting 52, by relative movement along the axis 28, exemplary projection 56 is advanced into and along the leg 64 until it abuts a circumferential edge 68, which bounds the leg 66. By then moving the connecting part 18 relative to the fitting 52 around the axis 28 in the direction of the arrow 69 in FIG. 3, the projection 56 is caused to move into the leg 66. This rotational movement changes the connecting part 18 from a released state into a secured state. In the secured state, the projection 56 abuts to an edge 70, bounding the leg 66, to prevent separation of the first connecting assembly 26 from the connecting port 14.

Figure 4:
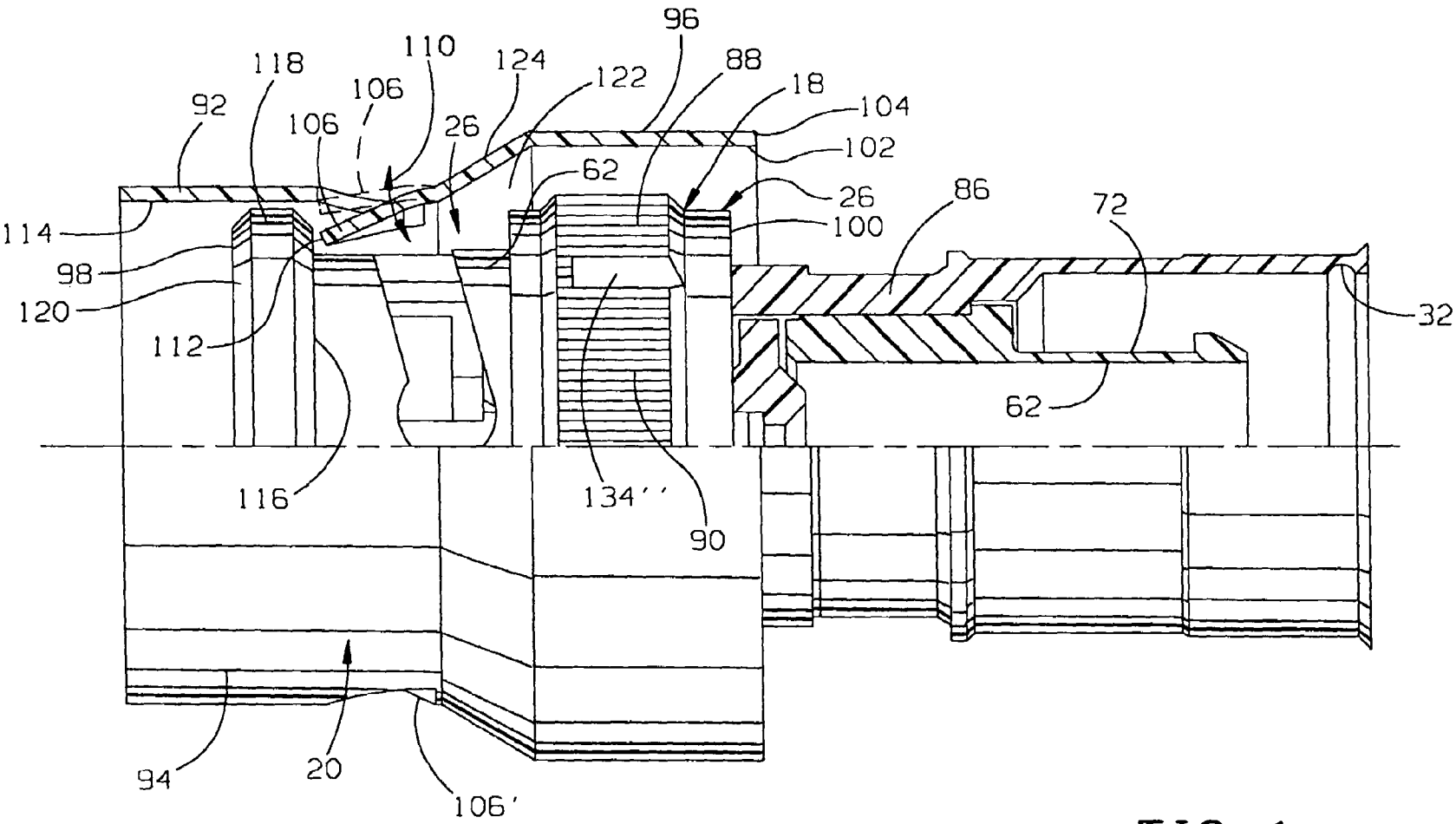
FIG. 4 is an enlarged, partially broken away, elevation view of the tubular fitting in FIG. 3 with the shield assembly in an operative state.
Figure 5:
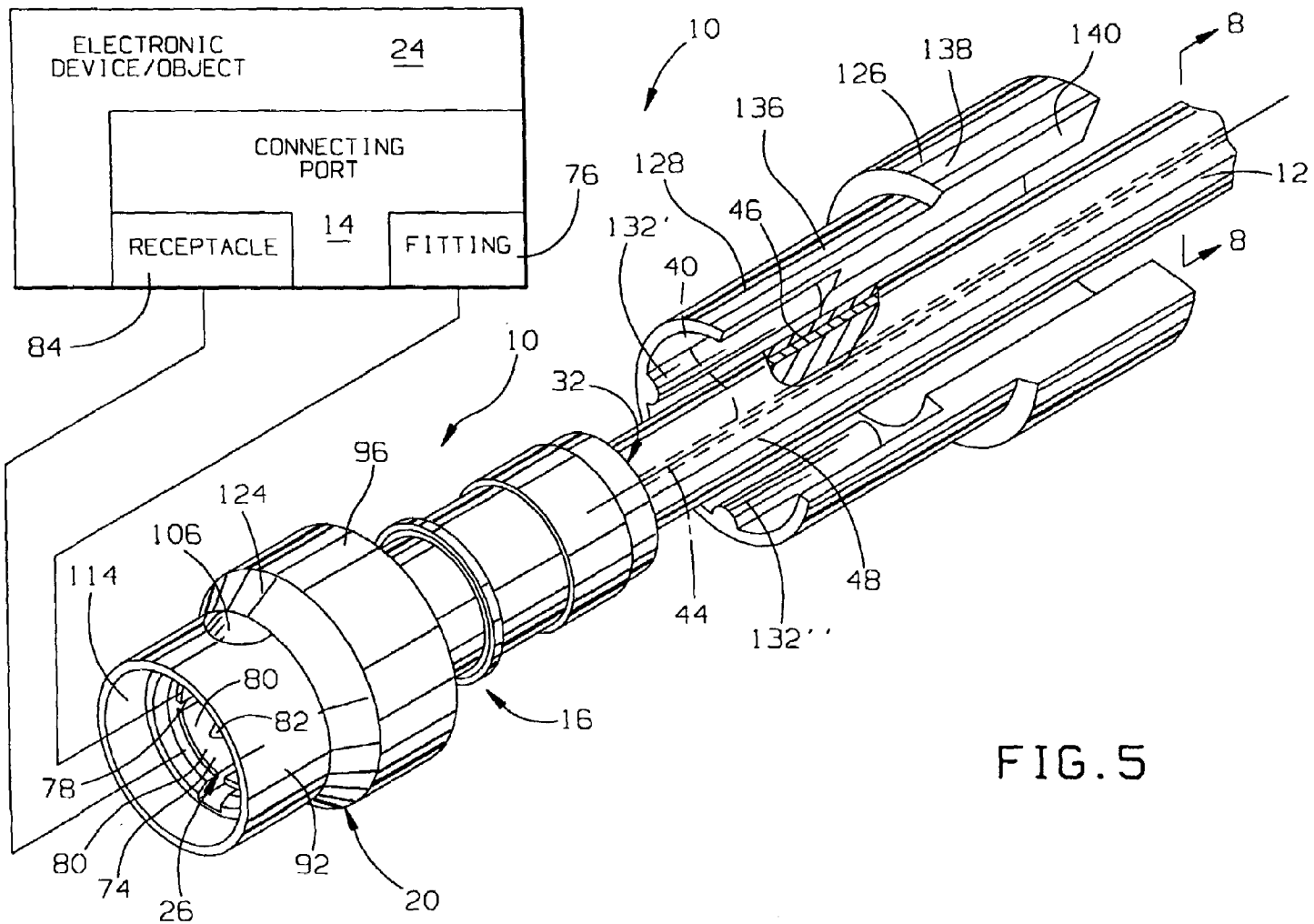
FIG. 5 is a partially schematic, perspective view of the tubular fitting in FIG. 3, with the shield assembly in the operative state and with the operating tool surrounding a coaxial cable connected to the tubular fitting and situated preparatory to being engaged with the connecting part.
Figure 6:
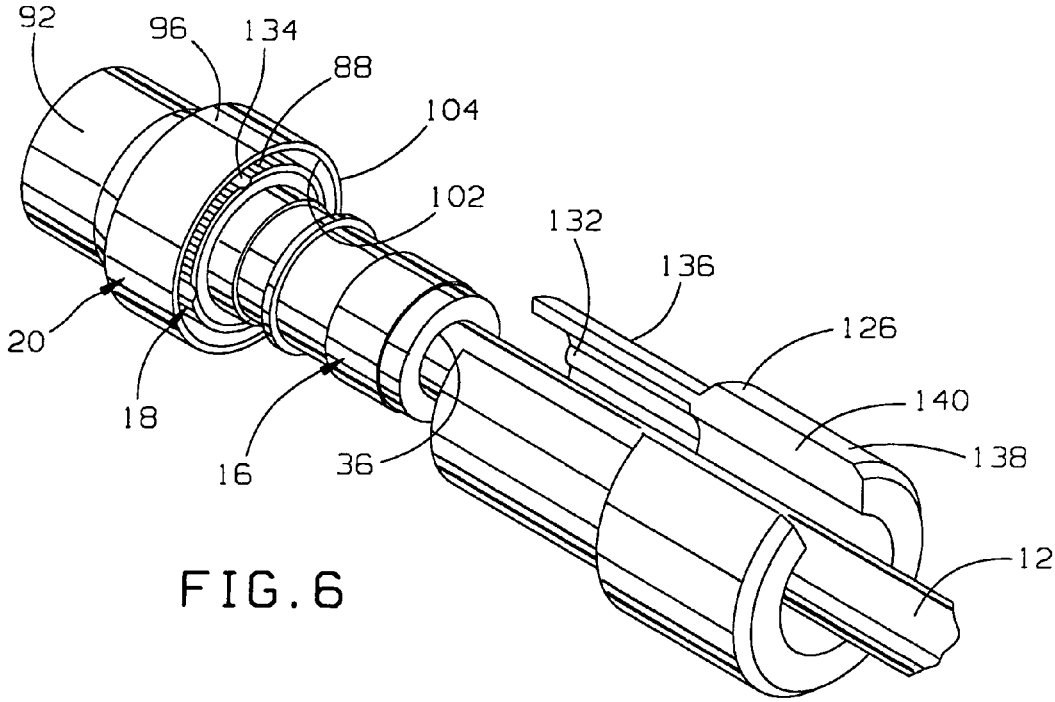
FIG. 6 is a perspective view, corresponding to that in FIG. 5, but taken at a different angle.
Figure 7:
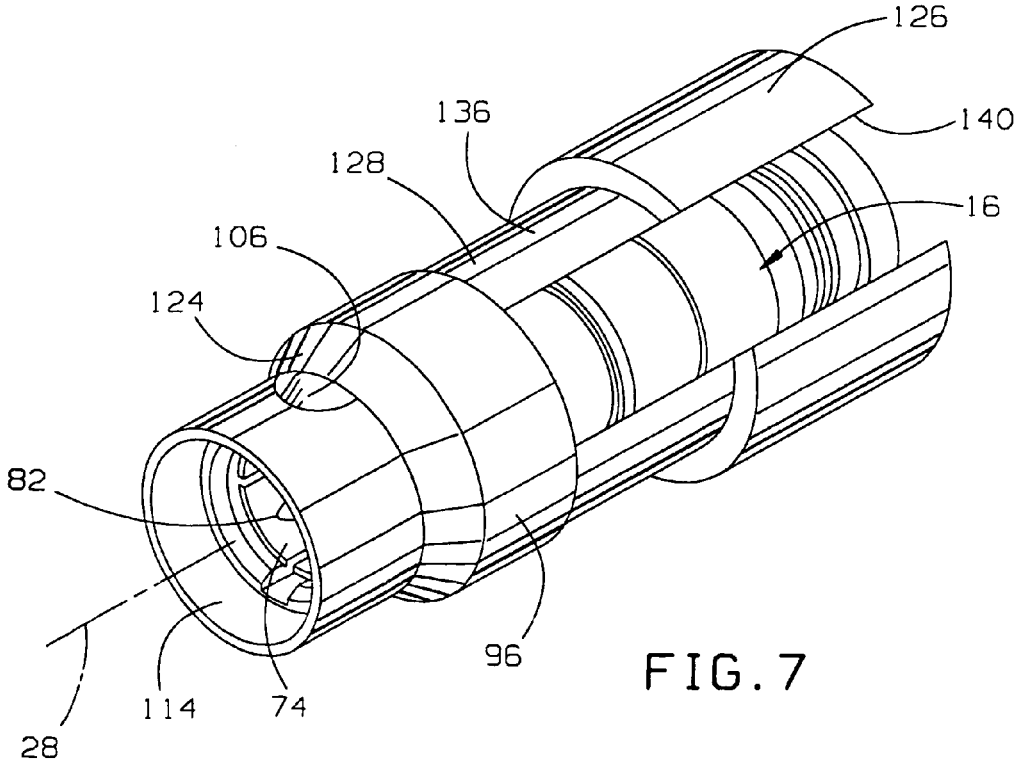
FIG. 7 is a view as in FIGS. 5 and 6 with the operating tool advanced into engaged relationship with the connecting part on the tubular fitting.

This same repositioning of the first connecting part 26 causes the coaxial cable 12 to be electrically connected at the connecting port 14, as seen in FIGS. 4 and 5. The tubular fitting 16 has a connecting body 72 with a through bore 62 with a substantially uniform diameter to snugly receive the insulating core 38 on the coaxial cable 12. The connecting body 72 is designed to wedge between the metallic sheath 46 and insulating core 38, as a suitably prepared end of the coaxial cable 12 is directed axially through the opening 36. An electrically conductive path is established from the connecting body 72 to a connector 74, which telescopingly engages with a fitting 76 on the connecting port 14. The connector 74 has a series of angularly spaced, axial extending slits 78, which produce bendable blades 80 that flex to accommodate receipt of the fitting 76, which becomes biasably gripped by the blades 80. With the tubular fitting 16 operatively engaged with the coaxial cable 12, a separate conductive path is defined between the inner conductor 40 and a cantilevered post 82 at the end 30 of the tubular fitting 16. The post 82 is received in a receptacle 84 on the connecting port 14 to make electrical contact with the electronic device/object 24 through the connecting port 14.

As noted above, the specific structure for establishing the electrical communication paths between the coaxial cable 12 and the connecting port 14 is not critical to the present invention. Similarly, the manner of maintaining the tubular fitting 16 operatively engaged with the coaxial cable 12 can be carried out by myriad different structures. In the embodiment shown, a crimped sleeve 86 fixes the coaxial cable 12 to the tubular fitting at the axial end 32 of the tubular fitting 16.

The connecting part 18 is movable between the secured and released states by grasping a circular, radially facing, outer surface 88, extending around the central axis 28. The outer surface 88 is knurled by providing raised ribs 90 at regularly, closely circumferentially spaced locations. The knurled outer surface 88 can be comfortably grasped between the fingers of a user to effect turning thereof between the secured and released states for the connecting part 18.

The shield assembly 20 cooperates with the tubular fitting 16 so that the shield assembly 20 is placed, and maintained, in an operative state, as shown in FIG. 4, through relative axial movement of the shield assembly 20 and tubular fitting 16. The shield assembly 20 can be placed in its operative state with the tubular fitting already operatively engaged with the coaxial cable 12. By moving the shield assembly 20, from the FIG. 3 state, axially relative to the tubular fitting 16, the shield assembly 20 can be "snap fit" into its operative state. While movement is shown as occurring in a linear path, this is not a requirement. In the operative state, the shield assembly 20 blocks radial access to the first connecting assembly 26 in a manner that would otherwise allow the first connecting part 18 to be engaged and moved from the secured state into the released state therefor. This radial access is normally gained by a user's fingers, or a tool, such as a wrench or pliers.

The shield assembly 20 has an annular wall 92 with a stepped diameter, including a smaller diameter portion 94 and a larger diameter portion 96. The annular wall 92 nominally conforms to the shape of the first connecting assembly 26 at the end 30 of the tubular fitting 16. In the operative state for the shield assembly 20, the smaller diameter portion 94 of the annular wall 92 projects at least to the free end 98 of the connecting part 14 at the end 30 thereof and, more preferably, beyond the end 30 of the tubular fitting 16. In the operative state, the shield assembly 20 also projects axially oppositely toward the end 32 of the tubular fitting 16 to beyond the end 100 of the connecting part 18. The larger diameter portion 96 of the shield assembly 20 has an opening 102, at one axial end 104 thereof, through which the connecting part 18 is exposed from an axial location.

The shield assembly 20 has a plurality of, and in this case two, tabs 106,106' formed thereon. In this embodiment, the tabs 106,106' are struck from the annular wall 92 radially inwardly to produce a deflectable, cantilevered construction. That is, the cantilevered arrangement of the exemplary tab 106 allows a degree of radial flexing, as indicated by the double-headed arrow 110 in FIG. 4.

The precise shape of the tabs 106,106', and their number, is not critical to the present invention. A single tab may function adequately, with the invention also contemplating a number of tabs in excess of the two shown. The exemplary tab 106, by reason of being bent radially inwardly, defines a shoulder/edge 112 projecting radially inwardly of an inside surface 114 on the smaller diameter portion 94 of the annular wall 92 and facing in one axial direction. The shield assembly 20 is maintained in the operative state by reason of the shoulder/edge 112 confronting a shoulder 116, defined at a juncture between a radially enlarged bead 118 on the annular end 50, and the annular wall 62, which shoulder 116 faces axially oppositely to the direction that the shoulder/edge 112 faces.

As the shield assembly 20 is moved from the FIG. 3 position towards its operative state, the first connecting assembly 26 passes through the opening 102 in the shield assembly 20. The first connecting assembly 26 radially centers within the shield assembly 20 by reason of the cooperation between a chamfered edge 120, on the radially enlarged bead 118 on the first connecting assembly 26, with a tapered surface 122 defined by a transition portion 124 on the annular wall 92 between the smaller and larger diameter portions 94,96, respectively.

As the edge 120 encounters the tab 106, continued relative axial movement causes the bead 118 to wedge the tab 106 radially outwardly to the dotted line position of FIG. 4, wherein the bead 118 is permitted to move axially beyond the tab 106. Once the bead 118 axially clears the shoulder/edge 112, the tab 106 is permitted to move back towards its initial solid line position in FIG. 4, to place the shoulder/edge 112 and shoulder 116 in confronting relationship. Thus, the shield assembly, through simple translational movement relative to the tubular fitting 16, is snap fit into the operative state, and is blocked from separating in an axial direction by the interaction of the shoulder/edge 112 and shoulder 116. The tab 106' functions in the same manner to produce a redundant holding structure.

With the shield assembly 20 in place, the connecting part 18 can be changed between secured and released states through the use of a specially designed operating tool 126. The tool 126 has an annular wall 128 with an inside surface 130 with a plurality, and in this case three, radially inwardly extending ribs 132,132',132". The ribs 132,132',132" are angularly alignable with radially inwardly extending receptacles 134,134',134" through the outer surface 88. The wall 128 is dimensioned to pass through the shield assembly opening 102 at the axial end 104 thereof into surrounding relationship with the outer surface 88. The inside surface 130 of the wall 128 closely surrounds the outer surface 88, whereby the ribs 132,132',132" move, one each, into the receptacles 134,134',134" to make a keyed connection between the tool 126 and the outer surface 88. With the tool 128 in engaged relationship with the outer surface on the connecting part 18, the tool 126 can be grasped and turned, either by hand, or through the use of a separate tool, to effect a corresponding angular movement of the connector part 18, keyed thereto, around the axis 28. The number of ribs and receptacles can be selected so that the tool 126 can be placed in engaged relationship in several different angular orientations without requiring any significant relative turning to effect registration of the ribs and receptacles.

In the embodiment shown, the annular wall 128 on the tool has a stepped diameter, with a smaller diameter portion 136 and a larger diameter portion 138. The larger diameter portion 138, upon being gripped, permits the imparting of a greater torque. The tool 126 could be configured to accommodate a conventional wrench, as by forming a polygonally-shaped outer surface (not shown) thereon which is conventionally engageable by the wrench.

The tool 126 has a lengthwise slot 140 through the annular wall 128 along the entire axial extent thereof, to allow the coaxial cable 12 to be directed radially therethrough, whereupon the tool 126 can be slid along the cable 12 up to the tubular fitting 16 and into engaged relationship with the connecting part 18. The slot 140 may have a circumferential width to accommodate the cable 12 or a larger width to accept the end 32 of the tubular fitting 16 for installation closer to the connecting part 18.

Figure 9:
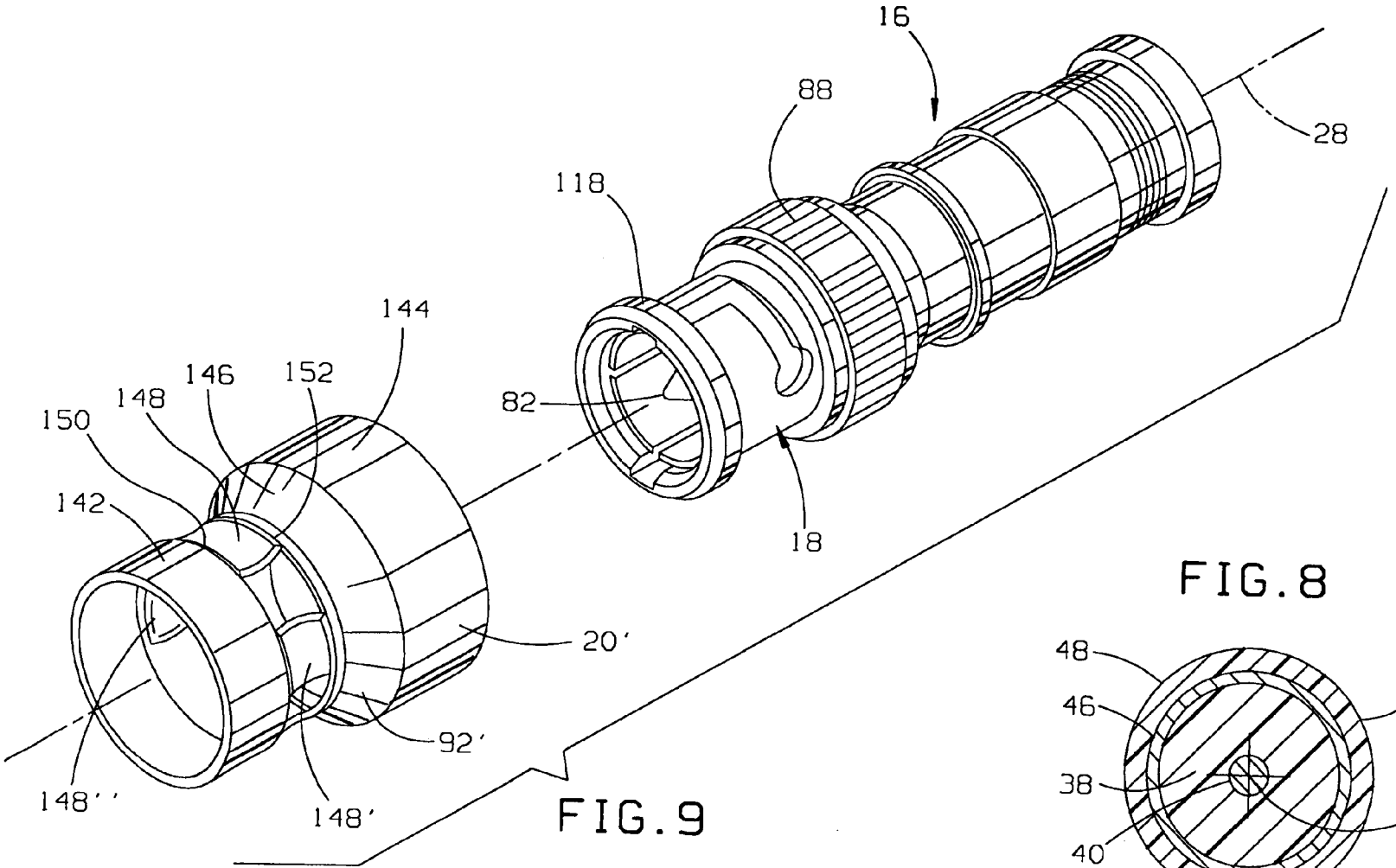
FIG. 9 is an exploded, perspective view of a modified form of shield assembly, according to the present invention, in relationship to a tubular fitting, as in FIGS. 3–7.
Figure 10:
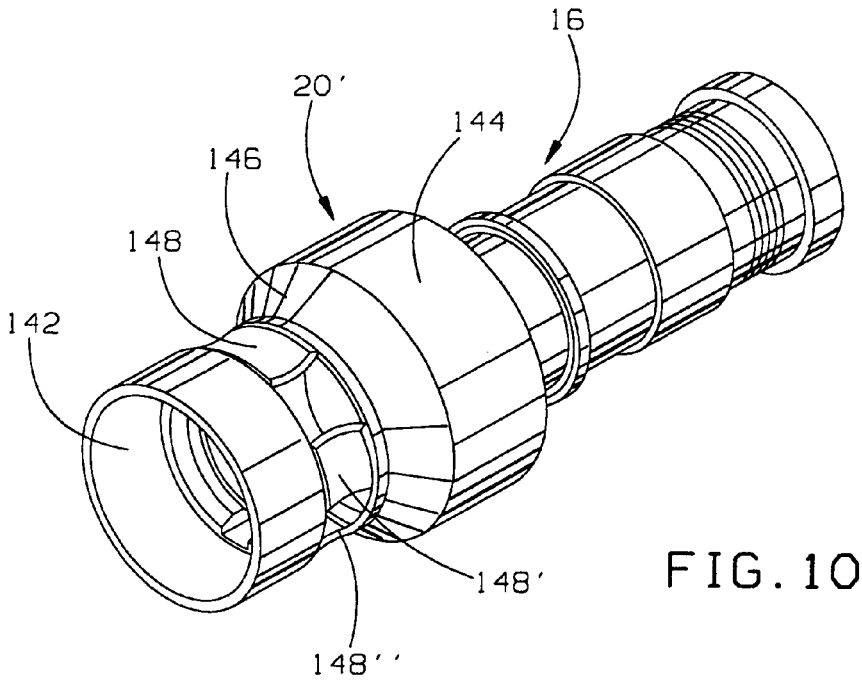
FIG. 10 is a view as in FIG. 9 with the shield assembly in an operative state.
Figure 11:
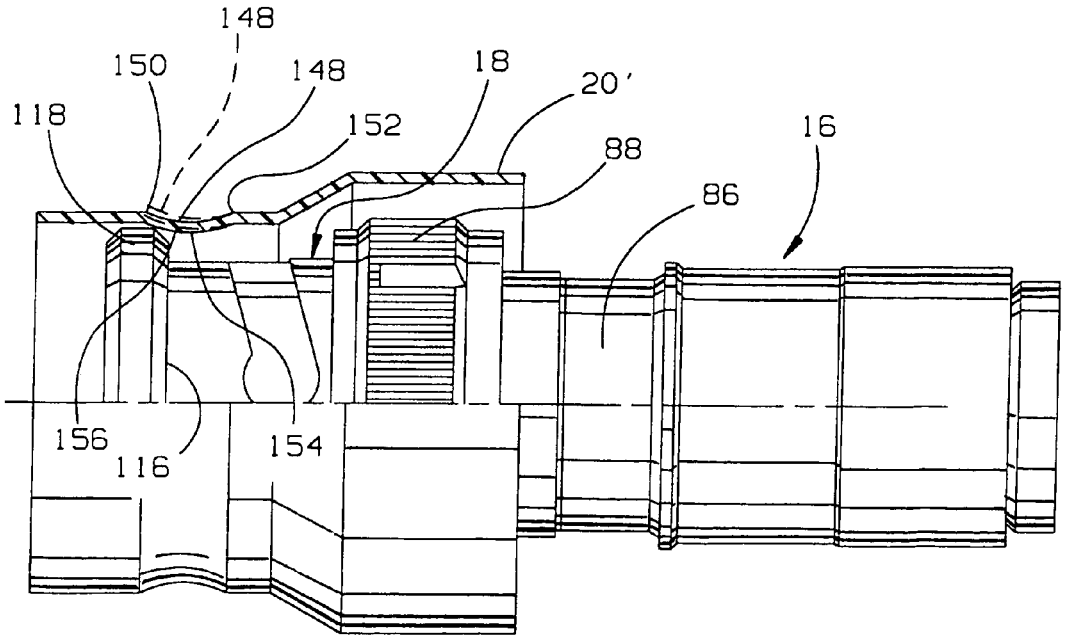
FIG. 11 is an enlarged, side elevation view of the tubular fitting with the shield assembly in the operative state and with part of the shield assembly broken away to show a connection between the shield assembly and the connecting part on the tubular fitting.

A further modified form of shield assembly is shown at 20' in FIGS. 8–10. The shield assembly 20' has an annular wall 92' with a smaller diameter portion 142, a larger diameter portion 144, and a tapering transition portion 146. Between the smaller diameter and transition portions 142, 146, a plurality, and in this case three, walls 148,148',148" are provided equidistantly angularly spaced with respect to the axis 28 of the tubular fitting 16. Exemplary wall 148 is concave, opening radially outwardly, and has spaced ends 150,152 connected to the smaller diameter portion 142 and transition portion 146, respectively. The shield assembly 20' is assembled to the tubular fitting 16 in the same manner that the shield assembly 20 is assembled thereto. The wall 148 has a radially inwardly facing surface 154 which resides in the path of the radially enlarged bead 118, as the shield assembly 20' and tubular fitting 16 are relatively axially moved. The surface 154 is cammed radially outwardly as this occurs so that the wall 148 assumes the dotted line position of FIG. 10, to allow passage of a substantial axial length of the wall 148 over and past the bead 118 with the shield assembly 20' in the operative state. In the operative state, the wall 148 is allowed to spring back towards its solid line position, wherein a shoulder 156 on the wall 148, facing in one axial direction, confronts the axially oppositely facing shoulder 116 on the bead 118.

The shield assembly 20' differs in function from the shield assembly 20 by reason of the fact that the "snap connected" shield assembly 20' can be separated from its operative state by reversing the assembly process. However, with the shield assembly 20' in the operative state, and the connecting part 18 operatively connected to the connecting port 14, separation of the shield assembly 20', by reverse axial movement over the end 30 of the tubular fitting 16, is prohibited. The shield assembly 20' is likewise press fit, and removably maintained in, the operative state preparatory to operatively connecting the connecting part 18 to the connecting port 14. As with the prior embodiments, the coaxial cable 12 can be operatively engaged with the tubular fitting 16 either before or after the connecting part 18 is connected to the connecting port 14.

In both embodiments, the smaller diameter portions 94,142 on the shield assemblies 20,20' are dimensioned so as not to permit passage of the shield assemblies 20,20' over the knurled outer surface 88 by movement of the shield assemblies 20, 20' from left to right in FIGS. 4 and 10. Such movement could otherwise expose the outer surface 88 to permit unauthorized manipulation therethrough of the connecting part 18 between secured and released states therefor.

Figure 12:
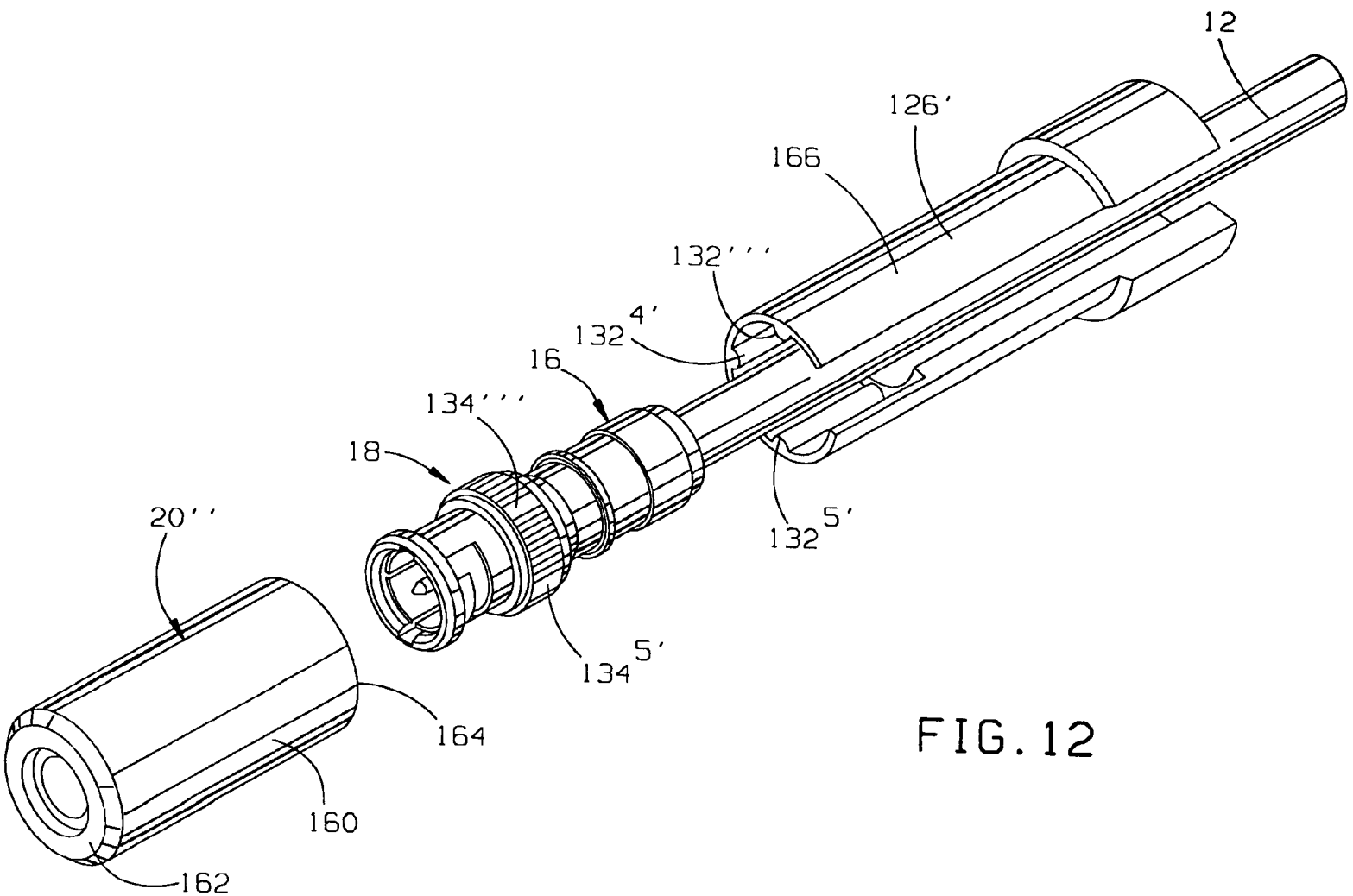
FIG. 12 is an exploded, perspective view of another form of shield assembly, according to the invention, in relationship to a tubular fitting, as in FIGS. 3–11, and with a modified form of tool for repositioning the connecting part.

Another form of shield assembly is shown at 20" in FIG. 12. The shield assembly 20" has an annular wall 160, surrounding the connecting part 18, that has a substantially constant diameter between axial ends 162,164 thereon. The shield assembly 20" can be connected to the connecting part 18 through structure of the type, previously described, or otherwise. In the operative state, the shield assembly 20" covers substantially the full axial extent of the tubular fitting 16. This necessitates the use of a tool 126' with an annular wall 166 with a substantially greater axial extent than the wall 128 on the tool 126, to allow keyed connection between ribs 132''',132$^{4'}$,132$^{5'}$, corresponding to the ribs 132,132', 132", with complementary receptacles (two shown) 134''', 134$^{5'}$, corresponding to the receptacles 134,134',134". The tool 126' otherwise operates in the same manner as the tool 126 to facilitate repositioning of the connecting part 18 between its secured and released states.

Figure 13:
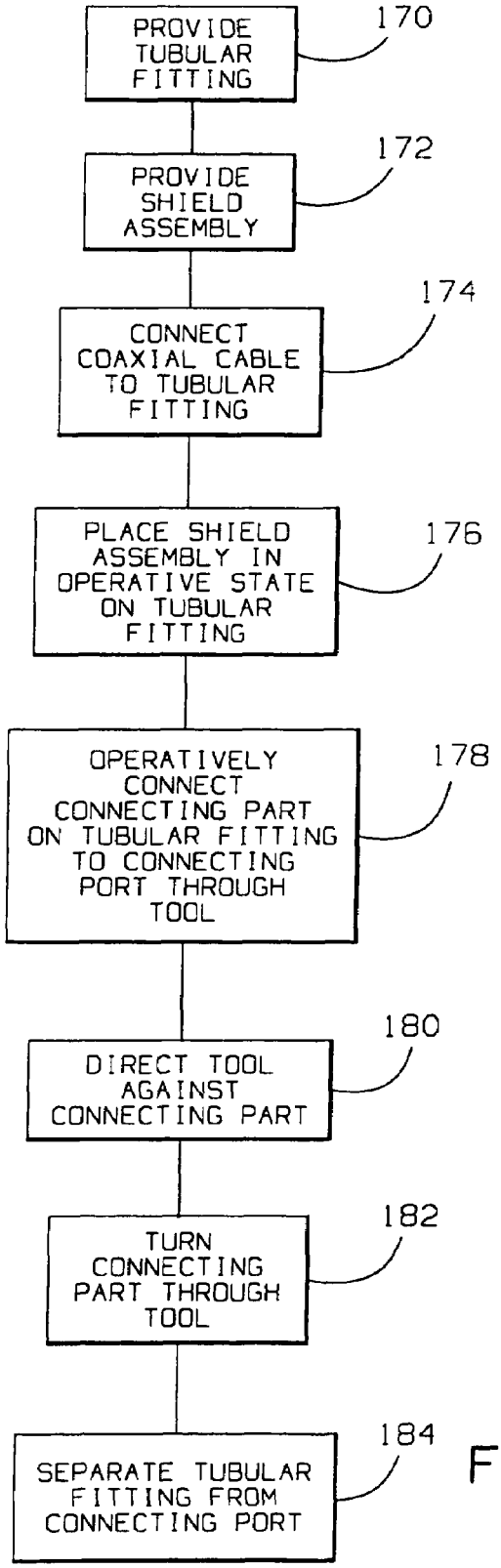
FIG. 13 is a flow diagram representation of a method for assembling and disassembling a coaxial cable to/from a connecting port, according to the present invention.

With the inventive structure, a secured connection between the connecting part 18 and connecting port 14 can be made as depicted in flow diagram form in FIG. 13 for the exemplary shield assembly 20. As shown at block 170, a tubular fitting 16 is provided having a central axis 28 and axially spaced first and second ends 30, 32, wherein the tubular fitting 16 has a first connecting assembly 26 with a first connecting part 18 that is movable around the central axis 28 selectively in (a) a first direction to a secured state and (b) oppositely to the first direction from the secured state into a released state.

As shown at block 172, a shield assembly 20 is provided. As shown at block 174, a coaxial cable 12 is operatively connected to the tubular fitting 16. As shown at block 176, the shield assembly 20 is moved relative to the tubular fitting 16 to place and maintain the shield assembly 20 in the operative state on the tubular fitting 16. This can be done after the coaxial cable 12 is operatively connected to the tubular fitting, but is more preferably done before the coaxial cable is operatively connected. In the operative state, the shield assembly 20 blocks radial access to the first connecting assembly 26 in a manner that allows the first connecting part 18 to be accessed and moved from the secured state into the released state therefrom.

Thereafter, the connecting part 18 on the tubular fitting 16 is operatively connected to the connecting port 14, as shown at block 178, through use of a tool 126. In the event that it is desired to disconnect the tubular fitting 16, the tool 126 is directed against the connecting part 18, as shown at block 180. Thereafter, the tool 126 is used to turn the connecting part 18 from the secured state to its released state. This allows the tubular fitting 18 to be separated from the connecting port 14, as shown at block 184.

While the invention has been described with particular reference to the drawings, it should be understood that various modifications could be made without departing from the spirit and scope of the present invention.

What is claimed is:

1. An assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part in the secured state maintaining a coaxial cable, operatively engaged with the tubular fitting, connected to the connecting port; and a shield assembly that blocks radial access to the first connecting assembly in a manner that allows the first connecting part to be accessed and moved from the secured state into the released state with the shield assembly in an operative state, the shield assembly cooperating with the tubular fitting to allow the shield assembly to be placed, and maintained, in the operative state by movement of the shield assembly axially relative to the tubular fitting in a direction from the second end of the tubular fitting towards the first end of the tubular fitting, wherein there is a first shoulder on the tubular fitting facing a first axial direction and a second shoulder on the shield assembly facing oppositely to the first axial direction, at least a part of at least one of the tubular fitting and shield assembly deformable to allow the first and second shoulders to move past each other as the shield assembly is moved into the operative state, whereupon the first and second shoulders confront each other to block separation of the shield assembly and tubular fitting by relative axial movement away from each other.

2. The assembly for connecting a coaxial cable to a connecting port according to claim 1 wherein one of the first and second shoulders is defined by a deflectable, cantilevered tab.

3. The assembly for connecting a coaxial cable to a connecting port according to claim 1 wherein one of the first and second shoulders is defined by a wall having axially spaced ends connected to one of the shield assembly and tubular fitting and the one of the first and second shoulders resides between the axially spaced ends of the wall.

4. The assembly for connecting a coaxial cable to a connecting port according to claim 1 wherein the shield assembly comprises a sleeve that is movable relative to the tubular fitting from the second end of the tubular fitting toward the first end of the tubular fitting to be placed in the operative state.

5. The assembly for connecting a coaxial cable to a connecting port according to claim 1 wherein the shield assembly comprises a sleeve with axially spaced ends and the sleeve comprises an annular wall that has a substantially constant diameter between the axially spaced ends of the sleeve.

6. The assembly for connecting a coaxial cable to a connecting port according to claim 1 wherein the shield assembly comprises a sleeve with axially spaced ends and the sleeve comprises an annular wall that has a stepped diameter between the axially spaced ends of the sleeve so as to conform to a shape of at least a part of the tubular fitting.

7. The assembly for connecting a coaxial cable to a connecting port according to claim 1 wherein with the shield assembly in the operative state, at least a part of the shield assembly and first connecting part are movable relative to each other around the central axis.

8. The assembly for connecting a coaxial cable to a connecting port according to claim 1 wherein with the shield assembly in the operative state the shield assembly projects beyond the second axial end of the tubular fitting.

9. The assembly for connecting a coaxial cable to a connecting port according to claim 1 in combination with a coaxial cable operatively engaged with the tubular fitting.

10. The assembly for connecting a coaxial cable to a connecting port according to claim 1 in combination with a tool that can be directed into engaged relationship with the first connecting part by axial movement of the tool relative to the first connecting part, whereupon the tool can be manipulated to move the first connecting part from the secured state into the released state.

11. The assembly for connecting a coaxial cable to a connecting port according to claim 10 wherein the first connecting part has a substantially circular, radially facing, outer surface and there are a cooperating radially extending rib and receptacle, one each on the tool and first connecting part, the rib movable into the receptacle to key the tool and first connecting part so that the tool can be moved around the central axis to change the first connecting part between the secured state and the released state.

12. The assembly for connecting a coaxial cable to a connecting port according to claim 11 wherein the outer surface is knurled to facilitate gripping engagement between the fingers of a user.

13. The assembly for connecting a coaxial cable to a connecting port according to claim 1 in combination with a connecting port to which the first connecting part is operatively connected.

14. The assembly for connecting a coaxial cable to a connecting port according to claim 13 wherein the connecting port is part of a portable electronic object.

15. An assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part in the secured state maintaining a coaxial cable, operatively engaged with the tubular fitting, connected to the connecting port, the first connecting part having a radially facing outer surface that is substantially circular around the central axis; and a shield assembly that blocks access to the outer surface in such a manner that allows the outer surface of the first connecting part to be gripped between a user's finger to facilitate turning of the first connecting part around the central axis with the shield assembly in an operative state, wherein the shield assembly cooperates with the tubular fitting to allow the shield assembly to be placed, and maintained, in the operative state by effecting relative axial movement of the shield assembly and tubular fitting, the assembly for connecting a coaxial cable to a connecting port further provided in combination with a tool that can be directed into engaged relationship with the first connecting part by axial movement of the tool relative to the first connecting part whereupon the tool can be manipulated to move the first connecting part between the secured state and the released state, wherein there are a cooperating radially extending rib and receptacle, one each on the tool and first connecting part, the rib movable into the receptacle to key the tool and first connecting part so that the tool can be moved around the central axis to thereby change the first connecting part from the secured state into the released state, the tool comprising a wall portion extending at least partially around the central axis at a first axial location and at least one of a) the rib projects radially from the wall portion and b) the receptacle is formed in the wall portion at the first axial location.

16. The assembly for connecting a coaxial cable to a connecting port according to claim 15 wherein the outer surface is knurled to facilitate gripping engagement between the fingers of a user.

17. The assembly for connecting a coaxial cable to a connecting port according to claim 15 wherein the shield assembly is integrally formed and joined with the tubular fitting.

18. The assembly for connecting a coaxial cable to a connecting port according to claim 15 wherein there is a first shoulder on the tubular fitting facing a first axial direction and a second shoulder on the shield assembly facing oppositely to the first axial direction, at least a part of at least one of the tubular fitting and shield assembly deformable to allow the first and second shoulders to move past each other as the shield assembly is moved into the operative state, whereupon the first and second shoulders confront each other to block separation of the shield assembly and tubular fitting by relative axial movement away from each other.

19. The assembly for connecting a coaxial cable to a connecting port according to claim 15 wherein the shield assembly comprises a sleeve that is movable relative to the tubular fitting in an axial direction from the second end of the tubular fitting toward the first end of the tubular fitting to be placed in the operative state.

20. The assembly for connecting a coaxial cable to a connecting port according to claim 15 wherein with the shield assembly in the operative state, at least a part of the shield assembly and first connecting assembly are movable relative to each other around the central axis.

21. The assembly for connecting a coaxial cable to a connecting port according to claim 15 in combination with a coaxial cable operatively engaged with the tubular fitting.

22. The assembly for connecting a coaxial cable to a connecting port according to claim 15 wherein the first connecting part has an axial extent and the rib/receptacle extends over the majority of the axial extent of the first connecting port.

23. The assembly for connecting a coaxial cable to a connecting port according to claim 15 in combination with a connecting port to which the first connecting part is operatively connected.

24. The assembly for connecting a coaxial cable to a connecting port according to claim 23 wherein the connecting port is part of a portable electronic object.

25. An assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part in the secured state maintaining a coaxial cable, operatively engaged with the tubular fitting, connected to the connecting port, a shield assembly that blocks radial access to the first connecting assembly in a manner that allows the first connecting part to be accessed and moved from the secured state into the released state, there being means on the shield assembly and tubular fitting cooperating to allow the shield assembly to be placed, and maintained, in an operative state by relative movement of the shield assembly and tubular fitting.

26. The assembly for connecting a coaxial cable to a connecting port according to claim 25 wherein the shield assembly and tubular fitting cooperate so that the shield assembly can be placed, and maintained, in the operative state by relative axial movement between the shield assembly and tubular fitting.

27. The assembly for connecting a coaxial cable to a connecting port according to claim 25 wherein the shield assembly is placed, and maintained, in the operative state by relative movement of the shield assembly and tubular fitting, one against and relative to the other.

28. The assembly for connecting a coaxial cable to a connecting port according to claim 25 in combination with a tool that can be directed into engaged relationship with the first connecting part by axial movement of the tool relative to the first connecting part, whereupon the tool can be manipulated to move the first connecting part from the secured state into the released state.

29. The assembly for connecting a coaxial cable to a connecting port according to claim 25 wherein the shield assembly comprises a sleeve that is movable relative to the tubular fitting in an axial direction from the second end of the tubular fitting toward the first end of the tubular fitting to be placed in the operative state.

30. The assembly for connecting a coaxial cable to a connecting port according to claim 25 wherein with the shield assembly in the operative state, at least a part of the shield assembly and first connecting assembly are movable relative to each other around the central axis.

31. The assembly for connecting a coaxial cable to a connecting port according to claim 25 in combination with a coaxial cable operatively engaged with the tubular fitting.

32. The assembly for connecting a coaxial cable to a connecting port according to claim 25 in combination with a connecting port to which the first connecting part is operatively connected.

33. The assembly for connecting a coaxial cable to a connecting port according to claim 32 wherein the connecting port is part of a portable electronic object.

34. A method of assembling a coaxial cable to a connecting port, the method comprising the steps of:

providing a tubular fitting having a central axis and axially spaced first and second ends and comprising a first connecting assembly comprising a first connecting part that is movable around the central axis selectively in (a) a first direction to a secured state and (b) oppositely to the first direction from the secured state into a released state, the tubular fitting operatively engagable with a coaxial cable directed into axially overlapping relationship with the tubular fitting at the first end of the tubular fitting;

providing a shield assembly;

moving the shield assembly relative to the tubular fitting so as to thereby place, and maintain, the shield assembly in an operative state wherein the shield assembly blocks radial access to the first connecting assembly in a manner that allows the first connecting part to be accessed and moved from the secured state into the released state and first and second shoulders, one each on the tubular fitting and shield assembly, abutted to thereby prevent separation of the tubular fitting and shield assembly by relative axial movement therebetween;

operatively connecting the coaxial cable to the tubular fitting at one axial end of the tubular fitting; and operatively connecting the first connecting part to the connecting port to connect the coaxial cable to the connecting port.

35. The method of assembling a coaxial cable to a connecting port according to claim 34 wherein the step of moving the shield assembly relative to the tubular fitting comprises snap fitting the shield assembly into the operative state.

36. The method of assembling a coaxial cable to a connecting port according to claim 34 further comprising the steps of directing a tool axially relative to the first connecting part and against the first connecting part and, through manipulation of the tool, causing the first connecting part to be moved from the secured state into the released state.

37. The method of assembling a coaxial cable to a connecting port according to claim 34 wherein the step of providing a tubular fitting comprises providing a tubular fitting with a first connecting part having a radially outwardly facing surface that is substantially circular around the central axis and knurled to facilitate gripping engagement between the fingers of a user.

38. The method of assembling a coaxial cable to a connecting port according to claim 34 wherein the step of moving the shield assembly comprises moving the shield assembly relative to the tubular fitting in an axial direction from the other axial end of the tubular fitting toward the one axial end of the tubular fitting.

39. The method of assembling a coaxial cable to a connecting port according to claim 34 wherein the step of placing the shield assembly in the operative state comprises placing the shield assembly in the operative state so that at least a part of the shield assembly and first connecting assembly are movable relative to each other around the central axis.

40. A method of assembling a coaxial cable to a connecting port, the method comprising the steps of:

providing a tubular fitting having a central axis and axially spaced first and second ends and comprising a first connecting assembly comprising a first connecting part that is movable around the central axis selectively in (a) a first direction to a secured state and (b) oppositely to the first direction from the secured state into a released state;

providing a shield assembly;

moving the shield assembly relative to the tubular fitting so as to thereby place, and maintain, the shield assembly in an operative state wherein the shield assembly blocks radial access to the first connecting assembly in a manner that allows the first connecting part to be accessed and moved from the secured state into the released state;

operatively connecting the coaxial cable to the tubular fitting at one axial end of the tubular fitting; and operatively connecting the first connecting part to the connecting port to connect the coaxial cable to the connecting port, wherein the step of operatively connecting the first connecting part comprises moving a projection on the connecting port axially within a first leg of a slot in the first connecting part a predetermined axial distance and thereafter moving the first connecting part around the central axis in the first direction into the secured state, whereby the projection moves in a second leg of the slot that is transverse to, and contiguous with, the first leg of the slot.

41. In combination:

a) an assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part comprising a slot comprising contiguous transverse first and second legs, the first connecting part in the secured state maintaining a coaxial cable, operatively engaged with the tubular fitting, connected to the connecting port; and a shield assembly that blocks radial access to the first connecting assembly in a manner that allows the first connecting part to be accessed and moved from the secured state into the released state with the shield assembly in an operative state, the shield assembly cooperating with the tubular fitting to allow the shield assembly to be placed, and maintained, in the operative state by relative axial movement of the shield assembly and tubular fitting; and b) a connecting port to which the first connecting part is operatively connected, the connecting port comprising a projection, the first connecting part operatively connectable to the connecting port by moving the projection on the connecting port axially within the first slot a predetermined axial distance and thereafter moving the first connecting part around the central axis in the first direction into the secured state, whereby the projection moves in the second leg of the slot.

42. In combination:

a) an assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part comprising a slot comprising contiguous transverse first and second legs, the first connecting part in the secured state maintaining a coaxial cable, operatively engaged with the tubular fitting, connected to the connecting port, the first connecting part having a radially facing outer surface that is substantially circular around the central axis; and a shield assembly that blocks access to the outer surface in such a manner that allows the outer surface of the first connecting part to be gripped between a user's finger to facilitate turning of the first connecting part around the central axis with the shield assembly in an operative state, b) a connecting port to which the first connecting part is operatively connected, the connecting port comprising a projection, the first connecting part operatively connectable to the connecting port by moving the projection on the connecting port axially within the first slot a predetermined axial distance and thereafter moving the first connecting part around the central axis in the first direction into the secured state, whereby the projection moves in the second leg of the slot.

43. In combination:

a) an assembly for connecting a coaxial cable to a connecting port, the connecting assembly comprising:

a tubular fitting having a central axis and axially spaced first and second ends, the tubular fitting operatively engageable with a coaxial cable directed into axially overlapping relationship with the tubular fitting at the first end of the tubular fitting, the tubular fitting comprising a first connecting assembly comprising a first connecting part that is movable around the central axis selectively in (a) a first direction to a secured state and (b) oppositely to the first direction from the secured state into a released state, the first connecting part comprising a slot comprising contiguous transverse first and second legs, the first connecting part in the secured state maintaining a coaxial cable, operatively engaged with the tubular fitting, connected to the connecting port, a shield assembly that blocks radial access to the first connecting assembly in a manner that allows the first connecting part to be accessed and moved from the secured state into the released state, there being means on the shield assembly and tubular fitting cooperating to allow the shield assembly to be placed, and maintained, in an operative state by relative movement of the shield assembly and tubular fitting; and b) a connecting port to which the first connecting part is operatively connected, the connecting port comprising a projection, the first connecting port operatively connectable to the connecting part by moving the projection on the connecting port axially within the first slot a predetermined axial distance and thereafter moving the first connecting part around the central axis in the first direction into the secured state, whereby the projection moves in the second leg of the slot.

* * * * *